US010565952B1

(12) United States Patent
Li

(10) Patent No.: US 10,565,952 B1
(45) Date of Patent: Feb. 18, 2020

(54) GOA CIRCUIT AND LIQUID CRYSTAL DISPLAY DEVICE

(71) Applicant: Shenzhen China Star Optoelectronics Technology Co., Ltd., Shenzhen, Guangdong (CN)

(72) Inventor: Wenying Li, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 92 days.

(21) Appl. No.: 15/578,530

(22) PCT Filed: Aug. 3, 2017

(86) PCT No.: PCT/CN2017/095742

§ 371 (c)(1),
(2) Date: Jul. 26, 2018

(87) PCT Pub. No.: WO2019/010736

PCT Pub. Date: Jan. 17, 2019

(30) Foreign Application Priority Data

Jul. 10, 2017 (CN) ..... 2017 1 0556834

(51) Int. Cl.
*G09G 3/36* (2006.01)
*G09G 3/3266* (2016.01)

(52) U.S. Cl.
CPC ..... *G09G 3/3677* (2013.01); *G09G 3/3266* (2013.01); *G09G 2310/0267* (2013.01); *G09G 2310/0281* (2013.01); *G09G 2310/0283* (2013.01); *G09G 2310/0286* (2013.01)

(58) Field of Classification Search
CPC ..... G09G 3/3677; G09G 3/3266; G09G 2310/0267; G09G 2310/0281; G09G 2310/0283; G09G 2310/0286
See application file for complete search history.

(56) References Cited

U.S. PATENT DOCUMENTS

2015/0294733 A1* 10/2015 Tan ..... G11C 19/28 345/204
2015/0325190 A1* 11/2015 Cao ..... G11C 19/28 345/100
2016/0189652 A1* 6/2016 Xiao ..... G09G 3/3677 327/109
2016/0343335 A1* 11/2016 Cao ..... G09G 3/36
2018/0226008 A1* 8/2018 Zhou ..... G09G 3/20
2018/0277043 A1* 9/2018 Li ..... G11C 19/28
2018/0330687 A1* 11/2018 Zeng ..... G02F 1/13
2018/0336834 A1* 11/2018 Liu ..... H01L 33/00
2019/0005867 A1* 1/2019 Hao ..... G11C 19/28
2019/0012966 A1* 1/2019 Shi ..... G09G 3/3677
2019/0139486 A1* 5/2019 Li ..... G09G 3/36

* cited by examiner

*Primary Examiner* — Tom V Sheng

(57) ABSTRACT

Disclosed are a GOA circuit and a liquid crystal display device. The GOA circuit includes multistage GOA sub-circuits. Each stage of GOA sub-circuit includes a pull-up control unit, a pull-up unit, a transfer unit, a pull-down unit, a pull-down holding unit and a bootstrap unit. The bootstrap unit includes a first capacitor, a second capacitor, a first thin-film transistor and a second thin-film transistor. The first capacitor and the second capacitor are used as coupling capacitors for node Q so as to boost a voltage at node Q and enhance driving capability of the GOA circuit.

20 Claims, 6 Drawing Sheets

GOA CIRCUIT AND LIQUID CRYSTAL DISPLAY DEVICE

CROSS-REFERENCE TO RELATED APPLICATIONS

This application claims the priority of Chinese patent application CN 201710556834.4, entitled "GOA circuit and liquid crystal display device" and filed on Jul. 10, 2017, the entirety of which is incorporated herein by reference.

FIELD OF THE INVENTION

The present disclosure relates to the technical field of liquid crystal display devices, and in particular, to a GOA circuit and a liquid crystal display device.

BACKGROUND OF THE INVENTION

Liquid crystal display devices become display terminals of mobile communication devices, computers, televisions, etc, because of advantages of high display quality, low price and portability. A generally used technology for driving a panel of a liquid crystal display device for a television is a gate driver on array (GOA) technology. In the GOA technology, a driving circuit of horizontal scanning lines of a panel is manufactured on a substrate around a display area by using an original process for manufacturing a flat display panel. By means of the GOA technology, the process for manufacturing the flat display panel can be simplified, and a bonding procedure in a horizontal scanning line direction is not needed. In this way, productivity can be improved, and cost of products can be reduced. Besides, integration degree of a display panel can be improved, so that the display panel is more suitable for manufacturing narrow-bezel or no-bezel display products so as to satisfy pursuit in vision of modern people.

In the liquid crystal display device, each pixel comprises a thin-film transistor (TFT). A gate of the thin-film transistor is connected to a scanning line, a drain thereof is connected to a data line, and a source thereof is connected to a pixel electrode. When a sufficient voltage is applied to a scanning line, all thin-film transistors on the scanning line can be turned on. At this time, a display signal voltage on a data line is written into a pixel so as to control transmittance of light of different liquid crystals and further achieve color control.

An existing GOA circuit generally comprises multiple GOA units in cascade connection. Each stage of GOA unit is configured to drive a corresponding stage of scanning line. A GOA unit mainly comprises a pull-up part, a pull-up control part, a transfer part, a key pull-down part, and a pull-down holding part and a boost capacitor which is configured to boost an electric potential. The pull-up part is mainly configured to output a clock signal as a gate signal. The pull-up control part is configured to control turn-on time of the pull-up part, and is generally connected with a transfer signal or a gate signal transmitted from a previous-stage GOA unit. The pull-down part is configured to pull down a gate signal to a low level as soon as possible, i.e., to turn off the gate signal. The pull-down holding part is configured to maintain a gate output signal and a gate signal of the pull-up part in a turn-off state. Generally, two pull-down holding parts are provided, and they function alternately. The boost capacitor is configured to boost a voltage at node Q for a second time, which is beneficial for outputting a G(N) signal of the pull-up part.

FIG. 1 shows a connection mode of multiple stages of a GOA circuit used in a flat display device in the prior art. In FIG. 1, metal wires of a first low-frequency clock signal LC1, a second low-frequency clock signal LC2, a direct-current low voltage VSS and four high-frequency clock signals CK1 to CK4 are provided at peripheries of the GOA circuit at left and right sides of a panel. A plurality of data lines for providing data signals, a plurality of scanning lines for providing scanning signals and a plurality of pixels P which are arranged in array are disposed. Each pixel P is electrically connected to one data line and one scanning line. A plurality of shift registers, i.e., S(N−3), S(N−2), S(N−1), and S(N) (which are not shown in FIG. 1), are arranged sequentially. Each of the shift registers is configured to output a gate signal for scanning a corresponding scanning line in a display device, and respective shift registers are electrically connected to the first low-frequency clock signal LC1, the second low-frequency clock signal LC2, the direct-current low voltage VSS and one high-frequency clock signal of the four high-frequency clock signals CK1 to CK4.

Specifically, an $N^{th}$-stage GOA circuit receives the first low-frequency clock signal LC1, the second low-frequency clock signal LC2, the direct-current low voltage VSS, one high-frequency clock signal of the four high-frequency clock signals CK1 to CK4, a G(N−2) signal and a turn-on signal ST(N−2) generated by an $(N-2)^{th}$-stage GOA circuit, and a G(N+2) signal generated by an $(N+2)^{th}$-stage GOA circuit respectively, and the $N^{th}$-stage GOA circuit generates G(N), ST(N), and Q(N) signals.

However, the voltage at node Q of the above GOA circuit is low, and therefore driving performance of the GOA circuit is not high.

SUMMARY OF THE INVENTION

The present disclosure provides a GOA circuit and a liquid crystal display device for solving a technical problem of low driving performance of the GOA circuit caused by a low voltage at node Q in the prior art.

The present disclosure provides a GOA circuit. The GOA circuit comprises multistage GOA sub-circuits, and each stage of GOA sub-circuit comprises a pull-up control unit, a pull-up unit, a transfer unit, a pull-down unit, a pull-down holding unit and a bootstrap unit. The pull-up control unit is connected to a first signal input end, a second signal input end and a first node, and is configured to output a voltage signal at the second signal input end to the first node under control of the first signal input end. The pull-up unit is connected to a first high-frequency clock signal input end, a first signal output end and the first node, and is configured to output a clock signal at the first high-frequency clock signal input end to the first signal output end. The transfer unit is connected to the first high-frequency clock signal input end, the first node and a second signal output end, and is configured to provide a voltage signal to a second signal input end of another stage of GOA sub-circuit. The pull-down unit is connected to the first node, the first signal output end, a third signal input end and a direct-current low-voltage input end, and is configured to pull down an output signal at the first signal output end to a low level. The pull-down holding unit is connected to the first node, the direct-current low-voltage input end, a first low-frequency clock signal input end, a second low-frequency clock signal input end and the first signal output end, and is configured to hold the output signal at the first signal output end at a low level. The bootstrap unit comprises a first capacitor, a second capacitor, a first thin-film transistor and a second thin-film transistor. A first end of the first capacitor is connected to the first node, and a second end of the first capacitor is connected to a first end of the second capacitor, a second end of the second capacitor being connected to the first signal output end; a first pole, a second pole and a gate of the first thin-film transistor are respectively connected to a second high-frequency clock signal input end, the first end of the second capacitor and a fourth signal input end in one-to-one correspondence; and a first pole, a second pole and a gate of the second thin-film transistor are respectively connected to the first end of the second capacitor, the direct-current low-voltage input end and the third signal input end in one-to-one correspondence.

Preferably, the pull-down unit comprises a third thin-film transistor and a fourth thin-film transistor. A first pole, a second pole and a gate of the third thin-film transistor are respectively connected to the first signal output end, the direct-current low-voltage input end and the third signal input end in one-to-one correspondence. A first pole, a second pole and a gate of the fourth thin-film transistor are respectively connected to the first node, the direct-current low-voltage input end and the third signal input end in one-to-one correspondence.

Preferably, the pull-up control unit comprises a fifth thin-film transistor. A first pole, a second pole and a gate of the fifth thin-film transistor are respectively connected to the first signal input end, the first node and the second signal input end in one-to-one correspondence.

Preferably, the pull-down holding unit comprises a first pull-down holding circuit and a second pull-down holding circuit. The first pull-down holding circuit is connected to the first node, the direct-current low-voltage input end, the first low-frequency clock signal input end and the first signal output end, and is configured to hold the output signal at the first signal output end at a low level. The second pull-down holding circuit is connected to the first node, the direct-current low-voltage input end, the second low-frequency clock signal input end and the first signal output end, and is configured to hold the output signal at the first signal output end at a low level.

Preferably, the first pull-down holding circuit comprises a sixth thin-film transistor, a seventh thin-film transistor, an eighth thin-film transistor, a ninth thin-film transistor, a tenth thin-film transistor and an eleventh thin-film transistor. A first pole, a second pole and a gate of the sixth thin-film transistor are respectively connected to the first node, the direct-current low-voltage input end and a first pole of the tenth thin-film transistor in one-to-one correspondence. A first pole, a second pole and a gate of the seventh thin-film transistor are respectively connected to the first signal output end, the direct-current low-voltage input end and the first pole of the tenth thin-film transistor in one-to-one correspondence. A first pole and a gate of the eighth thin-film transistor are both connected to the first low-frequency clock signal input end, and a second pole of the eighth thin-film transistor is connected to a first pole of the eleventh thin-film transistor. A first pole, a second pole and a gate of the ninth thin-film transistor are respectively connected to the first low-frequency clock signal input end, the first pole of the tenth thin-film transistor and the first pole of the eleventh thin-film transistor in one-to-one correspondence. A second pole and a gate of the tenth thin-film transistor are respectively connected to the direct-current low-voltage input end and the first node in one-to-one correspondence. A second pole and a gate of the eleventh thin-film transistor are respectively connected to the direct-current low-voltage input end and the first node in one-to-one correspondence.

Preferably, the second pull-down holding circuit comprises a twelfth thin-film transistor, a thirteen thin-film transistor, a fourteenth thin-film transistor, a fifteenth thin-film transistor, a sixteenth thin-film transistor and a seventeenth thin-film transistor. A first pole, a second pole and a gate of the twelfth thin-film transistor are respectively connected to the first node, the direct-current low-voltage input end and a first pole of the sixteenth thin-film transistor in one-to-one correspondence. A first pole, a second pole and a gate of the thirteenth thin-film transistor are respectively connected to the first signal output end, the direct-current low-voltage input end and the first pole of the sixteenth thin-film transistor in one-to-one correspondence. A first pole and a gate of the fourteenth thin-film transistor are both connected to the second low-frequency clock signal input end, and a second pole of the fourteenth thin-film transistor is connected to a first pole of the seventeenth thin-film transistor. A first pole, a second pole and a gate of the fifteenth thin-film transistor are respectively connected to the second low-frequency clock signal input end, the first pole of the sixteenth thin-film transistor and the first pole of the seventeenth thin-film transistor in one-to-one correspondence. A second pole and a gate of the sixteenth thin-film transistor are respectively connected to the direct-current low-voltage input end and the first node in one-to-one correspondence. A second pole and a gate of the seventeenth thin-film transistor are respectively connected to the direct-current low-voltage input end and the first node in one-to-one correspondence.

Preferably, the transfer unit comprises an eighteenth thin-film transistor, and a first pole, a second pole and a gate of the eighteenth thin-film transistor are respectively connected to the first high-frequency clock signal input end, the second signal output end and the first node in one-to-one correspondence.

Preferably, the pull-up unit comprises a nineteenth thin-film transistor, and a first pole, a second pole and a gate of the nineteenth thin-film transistor are respectively connected to the first high-frequency clock signal input end, the first signal output end and the first node in one-to-one correspondence.

Preferably, the first pole is a drain, and the second pole is a source.

The present disclosure further discloses a liquid crystal display device which comprises the above GOA circuit.

In the GOA circuit and the liquid crystal display device provided by the present disclosure, the bootstrap unit comprises the first capacitor, the second capacitor, the first thin-film transistor and the second thin-film transistor. The first thin-film transistor can be used to boost a voltage between the first capacitor and the second capacitor, and the second thin-film transistor can be used to pull down the voltage between the first capacitor and the second capacitor. The first capacitor and the second capacitor are used as coupling capacitors for node Q, by means of which capacitive coupling for node Q can be performed twice so as to boost a voltage at node Q and enhance driving capability of the GOA circuit.

BRIEF DESCRIPTION OF THE DRAWINGS

The accompanying drawings are provided for better understanding the present disclosure, and constitute one part of the description. The accompanying drawings are used for explaining the present disclosure together with embodiments of the present disclosure, and do not constitute limitations to the present disclosure. In the drawings.

DETAILED DESCRIPTION OF THE EMBODIMENTS

The present disclosure will be explained in detail with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no conflict, respective technical features mentioned in respective embodiments can be combined together in any manner, and the technical solutions obtained in this manner all fall within the scope of the present disclosure.

Figure 1:
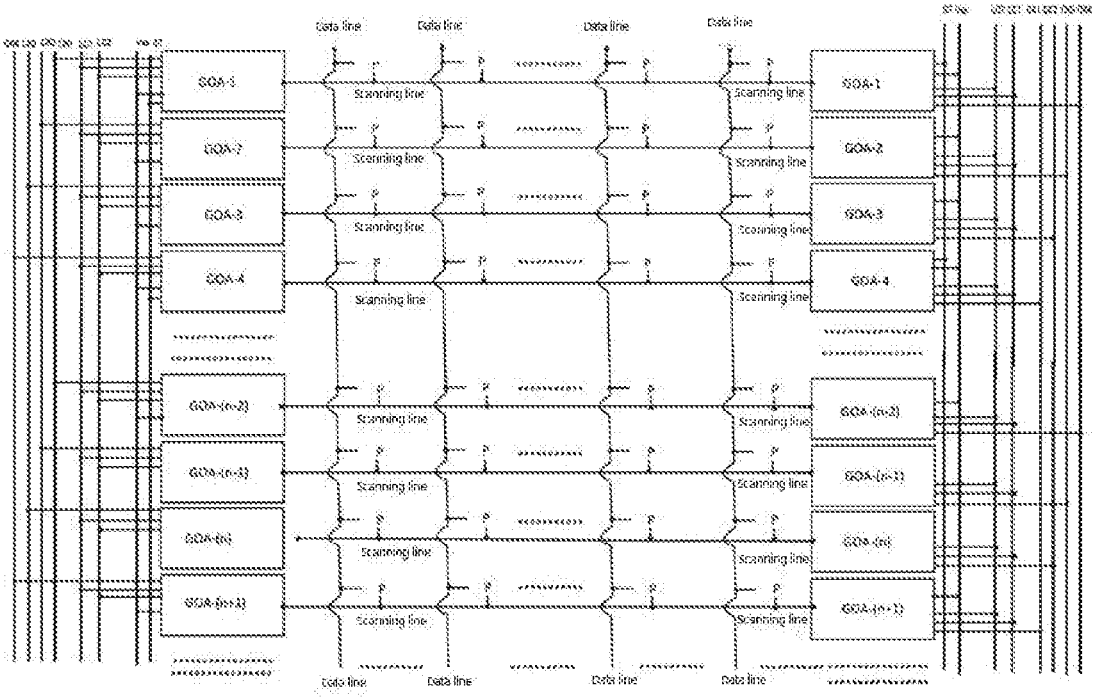
Fig. 1 (Prior art)
FIG. 1 shows a multistage GOA driving architecture in the prior art.
Figure 2:
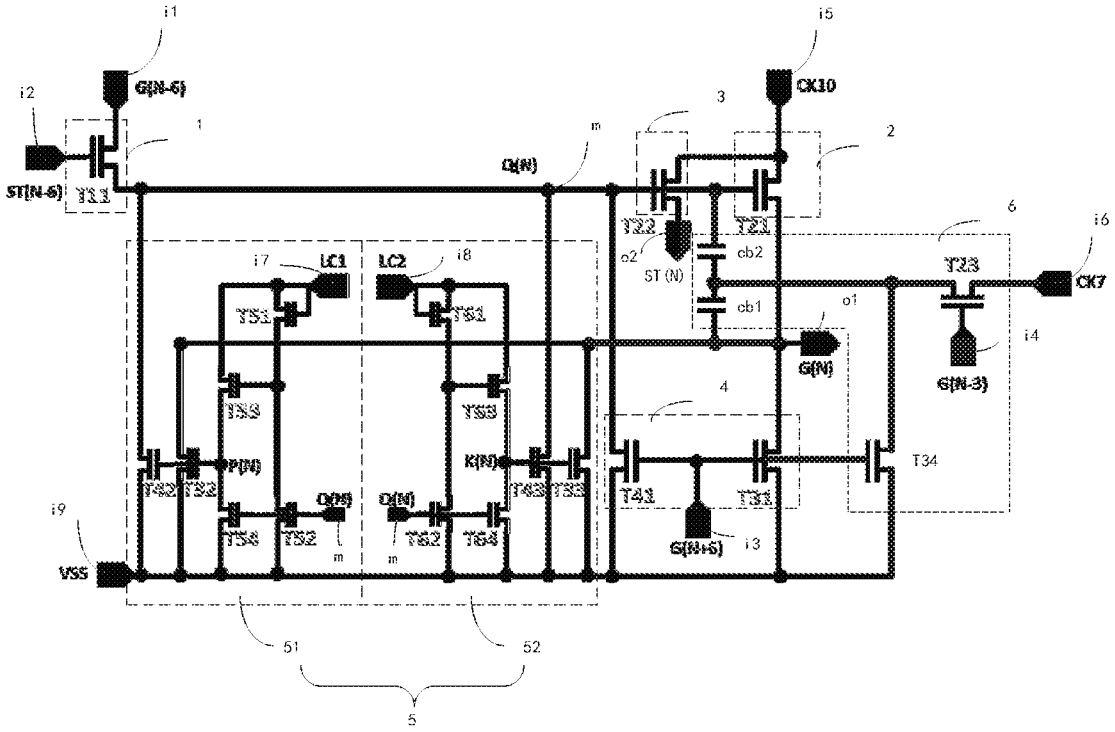
FIG. 2 schematically shows a structure of a GOA sub-circuit provided in embodiments of the present disclosure.

FIG. 2 schematically shows a structure of a GOA sub-circuit provided in embodiments of the present disclosure. As shown in FIG. 2, a GOA circuit is provided in the embodiments of the present disclosure. The GOA circuit comprises multiple stages of GOA sub-circuits. Each stage of GOA sub-circuit comprises a pull-up control unit 1, a pull-up unit 2, a transfer unit 3, a pull-down unit 4, a pull-down holding unit 5 and a bootstrap unit 6.

Generally, a GOA circuit comprises a turn-on signal STV, a first low-frequency clock signal LC1, a second low-frequency clock signal LC2, a direct-current low voltage VSS and four high-frequency clock signals CK1 to CK4. The turn-on signal is configured to turn on transistors T11 in first two stages of the GOA circuit and to pull down transistors T31 and T41 in last two stages of the GOA circuit. The first low-frequency clock signal LC1 and the second low-frequency clock signal LC2 perform a pull-down holding to the GOA circuit alternately. The GOA circuit is mainly configured to maintain signal Gn at a stable low level when a gate signal is in a turn-off state. Meanwhile, the signal Gn needed by a scanning line outputs a high level mainly via one of the four high-frequency clock signals, which enables a gate signal of a display panel to be in a well turn-on state so as to control a data signal to be input into a thin-film transistor of a pixel, and therefore a pixel P can be charged or discharged normally.

In the present embodiment, 12 high-frequency clock signals are provided, which are represented by CK1 to CK12 respectively. A number of the high-frequency clock signals can also be arranged to be a number other than 12, and is not defined herein. Therefore, an $N^{th}$-stage GOA sub-circuit receives a first low-frequency clock signal LC1, a second low-frequency clock signal LC2, a direct-current low-voltage signal VSS, high-frequency clock signals (two high-frequency clock signals in FIG. 2 are CK10 and CK7), an $(N-6)^{th}$-stage gate signal G(N−6) generated by an $(N-6)^{th}$-stage GOA sub-circuit (the $(N-6)^{th}$-stage gate signal G(N−6) is outputted at a first signal output end o1 of the $(N-6)^{th}$-stage GOA sub-circuit), an $(N-6)^{th}$-stage turn-on signal ST(N−6) generated by the $(N-6)^{th}$-stage GOA sub-circuit (the $(N-6)^{th}$-stage turn-on signal ST(N−6) is outputted at a second signal output end o2 of the $(N-6)^{th}$-stage GOA sub-circuit), an $(N+6)^{th}$-stage gate signal G(N+6) generated by an $(N+6)^{th}$-stage GOA sub-circuit (the $(N+6)^{th}$-stage gate signal G(N+6) is outputted at a first signal output end o1 of the $(N+6)^{th}$-stage GOA sub-circuit), and an $(N-3)^{th}$-stage gate signal G(N−3) generated by an $(N-3)^{th}$-stage GOA sub-circuit (the $(N-3)^{th}$-stage gate signal G(N−3) is outputted at a first signal output end o1 of the $(N-3)^{th}$-stage GOA sub-circuit). The $N^{th}$-stage GOA sub-circuit generates an $N^{th}$-stage gate signal G(N), an $N^{th}$-stage transfer signal ST(N) (i.e., an $(N+6)^{th}$-stage turn-on signal), and an $N^{th}$-stage first node output signal Q(N) at a first node m.

Figure 3A:
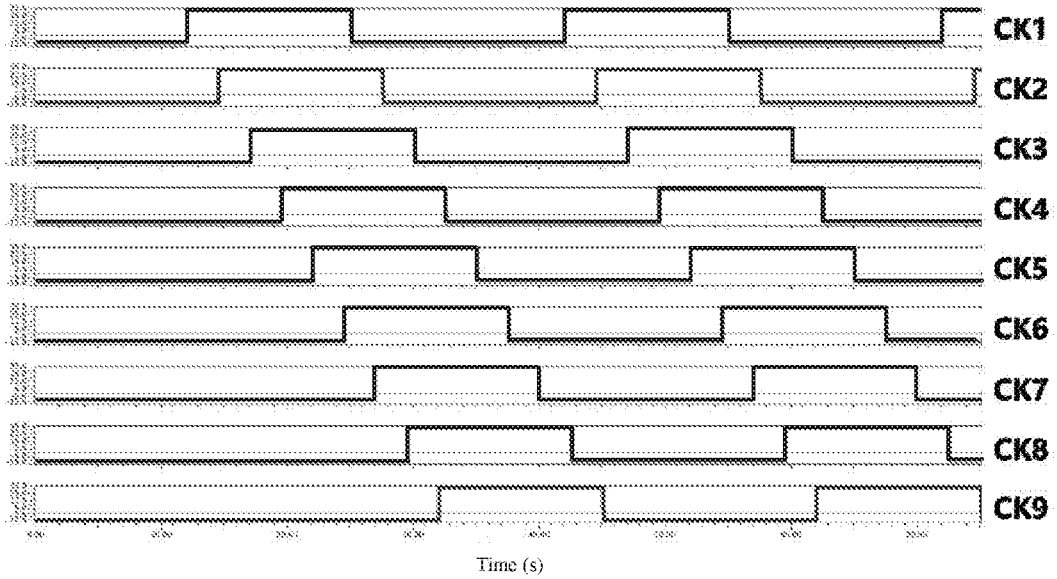
FIG. 3*a* to FIG. 3*c* show timing sequences of respective signals provided in the embodiments of the present disclosure.
Figure 3B:
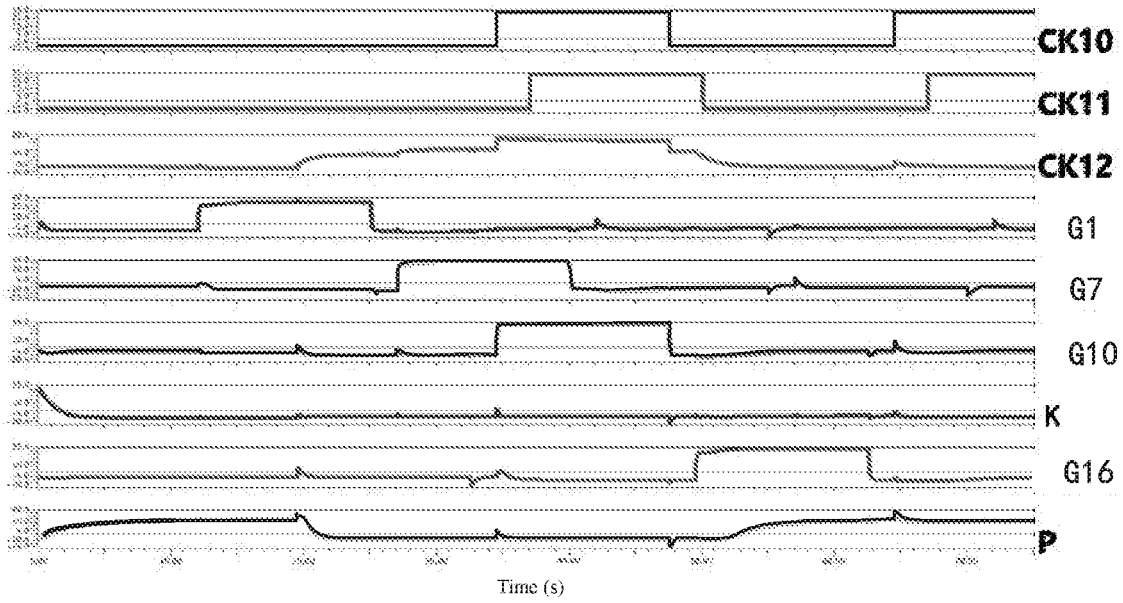
Figure 3C:
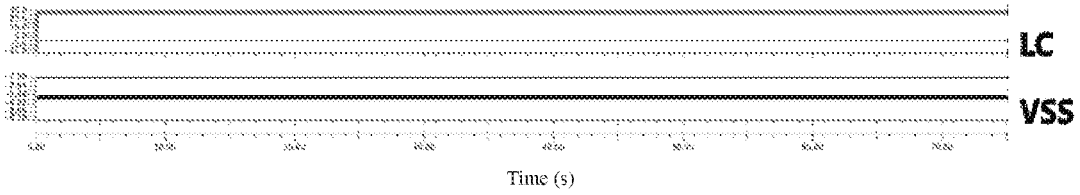

In the present embodiment, the $N^{th}$-stage GOA sub-circuit is taken as an example for descriptions. A signal provided by a first signal input end i1 is the $(N-6)^{th}$-stage gate signal G(N−6) generated by the $(N-6)^{th}$-stage GOA sub-circuit; a signal provided by a second signal input end i2 is an $(N-6)^{th}$-stage transfer signal ST(N−6) generated by the $(N-6)^{th}$-stage GOA sub-circuit; a signal provided by a third signal input end i3 is the $(N+6)^{th}$-stage gate signal G(N+6) generated by the $(N+6)^{th}$-stage GOA sub-circuit; and a signal provided by a fourth signal input end i4 is the $(N-3)^{th}$-stage gate signal G(N−3) generated by the $(N-3)^{th}$-stage GOA sub-circuit. A signal outputted by a first signal output end o1 is the $N^{th}$-stage gate signal G(N) generated by the $N^{th}$-stage GOA sub-circuit, and the first signal output end o1 is connected to an $N^{th}$-stage scanning line so as to provide the $N^{th}$-stage gate signal G(N) for it; a signal outputted by a second signal output end o2 is the $N^{th}$-stage transfer signal ST(N) generated by the $N^{th}$-stage GOA sub-circuit; and a signal outputted by the first node m is the $N^{th}$-stage first node output signal Q(N) generated by the $N^{th}$-stage GOA sub-circuit. A first low-frequency clock signal input end i7 provides the first low-frequency clock signal LC1; a second low-frequency clock signal input end i8 provides the second low-frequency clock signal LC2; a direct-current low-voltage input end i9 provides a direct-current low-voltage signal VSS; a first high-frequency clock signal input end i5 provides one of the high-frequency clock signals CK1 to CK12; a second high-frequency clock signal input end i6 provides one of the high-frequency clock signals CK1 to CK12. In the present embodiment, the high-frequency clock signal provided by the second high-frequency clock signal input end i6 is consistent with the high-frequency clock signal provided by the first high-frequency clock signal input end i5 in the $(N-3)^{th}$-stage GOA sub-circuit. FIG. 3*a* to FIG. 3*c* show timing sequences of respective signals. G1 represents a waveform of a gate signal at the first signal input end i1; G7 represents a waveform of a gate signal at the first signal output end o1; G10 represents a waveform of a gate signal at the fourth signal input end i4; G16 represents a waveform of a gate signal at the third signal input end i3; K represents a waveform at a node K(N) in FIG. 2; and P represents a waveform at a node P(N).

In the present embodiment, external turn-on signals are provided to first signal input ends i1 of first six stages of GOA sub-circuits and third signal input ends i3 of last six stages of GOA sub-circuits.

The pull-up control unit 1 is connected to the first signal input end i1, the second signal input end i2 and the first node m, and is configured to output a voltage signal at the second signal input end i1 to the first node m under control of the first signal input end i2. The pull-up unit 2 is connected to the first high-frequency clock signal input end i5, the first signal output end o1 and the first node m, and is configured to output a clock signal at the first high-frequency clock signal input end i5 to the first signal output end o1. The transfer unit 3 is connected to the first high-frequency clock signal input end i5, the first node m and the second signal output end o2, and is configured to provide a voltage signal for a second signal input end i2 of another stage of GOA sub-circuit. The voltage signal provided refers to a turn-on signal of the corresponding another stage of GOA sub-circuit.

The pull-down unit 4 is connected to the first node m, the first signal output end o1, the third signal input end i3 and the direct-current low-voltage input end i9, and is configured to pull down an output signal at the first signal output end o1 to a low level.

The pull-down holding unit 5 is connected to the first node m, the direct-current low-voltage input end i9, the first low-frequency clock signal input end i7, the second low-frequency clock signal input end i8 and the first signal output end o1, and is configured to hold the output signal at the first signal output end o1 at a low level.

The bootstrap unit 6 comprises a first capacitor Cb2, a second capacitor Cb1, a first thin-film transistor T23 and a second thin-film transistor T34. A first end of the first capacitor Cb2 is connected to the first node m, and a second end of the first capacitor Cb2 is connected to a first end of the second capacitor Cb1. A second end of the second capacitor Cb1 is connected to the first signal output end o1. A first pole, a second pole and a gate of the first thin-film transistor T23 are respectively connected to the second high-frequency clock signal input end i6, the first end of the second capacitor Cb1 and the fourth signal input end i4 in one-to-one correspondence. A first pole, a second pole and a gate of the second thin-film transistor T34 are respectively connected to the first end of the second capacitor Cb1, the direct-current low-voltage input end i9 and the third signal input end i3 in one-to-one correspondence.

Figure 4:
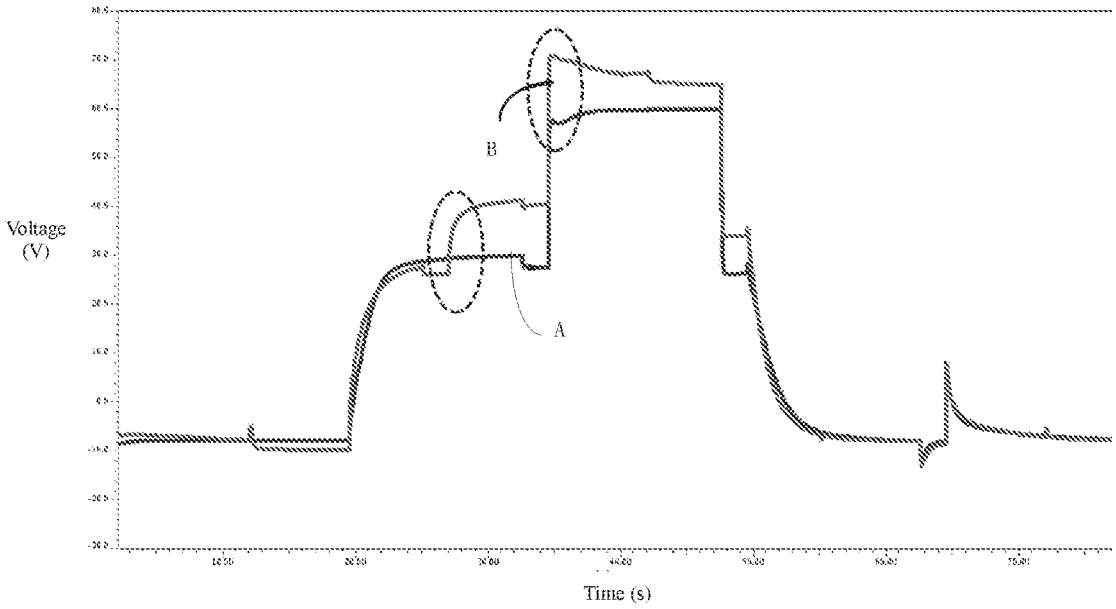
FIG. 4 shows a waveform at node Q according to a GOA circuit provided in the embodiments of the present disclosure.

In the GOA circuit provided in the present embodiment, the bootstrap unit 6 comprises the first capacitor Cb2, the second capacitor Cb1, the first thin-film transistor T23 and the second thin-film transistor T34. The first thin-film transistor T23 is configured to boost a voltage between the first capacitor Cb2 and the second capacitor Cb1, and the second thin-film transistor T34 is configured to pull down the voltage between the first capacitor Cb2 and the second capacitor Cb1. The first capacitor Cb2 and the second capacitor Cb1 are used as coupling capacitors for node Q, and capacitive coupling for node Q can be performed twice so as to boost a voltage at node Q and improve driving capability of the pull-up unit 2. FIG. 4 schematically shows a waveform of a voltage at node Q in a GOA circuit in the prior art and a waveform of a voltage at node Q in the GOA circuit in the present embodiment. A represents the waveform of the voltage at node Q in the GOA circuit in the prior art, and B represents the waveform of the voltage at node Q in the GOA circuit in the present embodiment. It can be easily seen from portions surrounded by dashed lines in FIG. 4 that, compared with the prior art, there is an obvious rise in the waveform of the voltage at node Q in the GOA circuit in the present embodiment, which greatly enhances driving capability of the GOA circuit.

In an embodiment of the present disclosure, the pull-down unit 4 comprises a third thin-film transistor T31 and a fourth thin-film transistor T41. A first pole, a second pole and a gate of the third thin-film transistor T31 are respectively connected to the first signal output end o1, the direct-current low-voltage input end i9 and the third signal input end i3 in one-to-one correspondence. A first pole, a second pole and a gate of the fourth thin-film transistor T41 are respectively connected to the first node m, the direct-current low-voltage input end i9 and the third signal input end i3 in one-to-one correspondence. The pull-down unit 4 is configured to pull down the $N^{th}$-stage gate signal G(N) to a low level, i.e., to turn off the $N^{th}$-stage gate signal G(N).

In another specific embodiment of the present disclosure, the pull-up control unit 1 comprises a fifth thin-film transistor T11. A first pole, a second pole and a gate of the fifth thin-film transistor T11 are respectively connected to the first signal input end i1, the first node m and the second signal input end i2 in one-to-one correspondence. The pull-up control unit 1 is configured to control turn-on time of an output signal of the pull-up unit 2.

In another specific embodiment of the present disclosure, the pull-down holding unit 5 comprises a first pull-down holding circuit 51 and a second pull-down holding circuit 52. The first pull-down holding circuit 51 is connected to the first node m, the direct-current low-voltage input end i9, the first low-frequency clock signal input end i7 and the first signal output end o1, and is configured to hold the output signal at the first signal output end o1 at a low level. The second pull-down holding circuit T52 is connected to the first node m, the direct-current low-voltage input end i9, the second low-frequency clock signal input end i8 and the first signal output end o1, and is configured to hold the output signal at the first signal output end o1 at a low level.

The first low-frequency clock signal LC1 provided by the first low-frequency clock signal input end i7 and the second low-frequency clock signal LC2 provided by the second low-frequency clock signal input end i8 perform a pull-down holding to the GOA sub-circuit alternately so as to hold the N h-stage gate signal G(N) and the output signal of the pull-up unit 2 in turn-off states.

In another specific embodiment of the present disclosure, the first pull-down holding circuit 51 comprises a sixth thin-film transistor T42, a seventh thin-film transistor T32, an eighth thin-film transistor T51, a ninth thin-film transistor T53, a tenth thin-film transistor T54 and an eleventh thin-film transistor T52. A first pole, a second pole and a gate of the sixth thin-film transistor T42 are respectively connected to the first node m, the direct-current low-voltage input end i9 and a first pole of the tenth thin-film transistor T54 in one-to-one correspondence. A first pole, a second pole and a gate of the seventh thin-film transistor T32 are respectively connected to the first signal output end o1, the direct-current low-voltage input end i9 and the first pole of the tenth thin-film transistor T54 in one-to-one correspondence. A first pole and a gate of the eighth thin-film transistor T51 are both connected to the first low-frequency clock signal input end i7, and a second pole of the eighth thin-film transistor T51 is connected to a first pole of the eleventh thin-film transistor T52. A first pole, a second pole and a gate of the ninth thin-film transistor T53 are respectively connected to the first low-frequency clock signal input end i7, the first pole of the tenth thin-film transistor T54 and the first pole of the eleventh thin-film transistor T52 in one-to-one correspondence. A second pole and a gate of the tenth thin-film transistor T54 are respectively connected to the direct-current low-voltage input end i9 and the first node m in one-to-one correspondence. A second pole and a gate of the eleventh thin-film transistor T52 are respectively connected to the direct-current low-voltage input end i9 and the first node m in one-to-one correspondence.

In another specific embodiment of the present disclosure, the second pull-down holding circuit 52 comprises a twelfth thin-film transistor T43, a thirteen thin-film transistor T33, a fourteenth thin-film transistor T61, a fifteenth thin-film transistor T63, a sixteenth thin-film transistor T64 and a seventeenth thin-film transistor T62. A first pole, a second pole and a gate of the twelfth thin-film transistor T43 are respectively connected to the first node m, the direct-current low-voltage input end i9 and a first pole of the sixteenth thin-film transistor T64 in one-to-one correspondence. A first pole, a second pole and a gate of the thirteenth thin-film transistor T33 are respectively connected to the first signal output end o1, the direct-current low-voltage input end i9 and the first pole of the sixteenth thin-film transistor T64 in one-to-one correspondence. A first pole and a gate of the fourteenth thin-film transistor T61 are both connected to the second low-frequency clock signal input end i8, and a second pole of the fourteenth thin-film transistor T61 is connected to a first pole of the seventeenth thin-film transistor T62. A first pole, a second pole and a gate of the fifteenth thin-film transistor T63 are respectively connected to the second low-frequency clock signal input end i8, the first pole of the sixteenth thin-film transistor T64 and the first pole of the seventeenth thin-film transistor T62 in one-to-one correspondence. A second pole and a gate of the sixteenth thin-film transistor T64 are respectively connected to the direct-current low-voltage input end i9 and the first node m in one-to-one correspondence. A second pole and a gate of the seventeenth thin-film transistor T62 are respectively connected to the direct-current low-voltage input end i9 and the first node m in one-to-one correspondence.

The transfer unit 3 comprises an eighteenth thin-film transistor T22. A first pole, a second pole and a gate of the eighteenth thin-film transistor T22 are respectively connected to the first high-frequency clock signal input end i5, the second signal output end o2 and the first node m in one-to-one correspondence. The transfer unit 3 is configured to provide a voltage signal for a second signal input end i2 of another stage of GOA sub-circuit.

The pull-up unit 2 comprises a nineteenth thin-film transistor T21. A first pole, a second pole and a gate of the nineteenth thin-film transistor T21 are respectively connected to the first high-frequency clock signal input end i5, the first signal output end o1 and the first node m in one-to-one correspondence. The pull-up unit 2 is configured to output a first high-frequency clock signal provided by a first high-frequency clock signal input end to be the $N^{th}$-stage gate signal G(N).

The first pole of each of the thin-film transistors is a drain, and the second pole thereof is a source.

A liquid crystal display device, which comprises the GOA circuit in the above embodiments, is further provided in the embodiments of the present disclosure.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A GOA circuit, comprising multistage GOA sub-circuits, wherein each stage of GOA sub-circuit comprises a pull-up control unit, a pull-up unit, a transfer unit, a pull-down unit, a pull-down holding unit and a bootstrap unit, wherein:

the pull-up control unit is connected to a first signal input end, a second signal input end and a first node, and is configured to output a voltage signal at the second signal input end to the first node under control of the first signal input end;

the pull-up unit is connected to a first high-frequency clock signal input end, a first signal output end and the first node, and is configured to output a clock signal at the first high-frequency clock signal input end to the first signal output end;

the transfer unit is connected to the first high-frequency clock signal input end, the first node and a second signal output end, and is configured to provide a voltage signal to a second signal input end of another stage of GOA sub-circuit;

the pull-down unit is connected to the first node, the first signal output end, a third signal input end and a direct-current low-voltage input end, and is configured to pull down an output signal at the first signal output end to a low level;

the pull-down holding unit is connected to the first node, the direct-current low-voltage input end, a first low-frequency clock signal input end, a second low-frequency clock signal input end and the first signal output end, and is configured to hold the output signal at the first signal output end at a low level; and the bootstrap unit comprises a first capacitor, a second capacitor, a first thin-film transistor and a second thin-film transistor, wherein a first end of the first capacitor is connected to the first node, and a second end of the first capacitor is connected to a first end of the second capacitor, a second end of the second capacitor being connected to the first signal output end; a first pole, a second pole and a gate of the first thin-film transistor are respectively connected to a second high-frequency clock signal input end, the first end of the second capacitor and a fourth signal input end in one-to-one correspondence; and a first pole, a second pole and a gate of the second thin-film transistor are respectively connected to the first end of the second capacitor, the direct-current low-voltage input end and the third signal input end in one-to-one correspondence.

2. The GOA circuit according to claim 1, wherein the pull-down unit comprises a third thin-film transistor and a fourth thin-film transistor, wherein:

a first pole, a second pole and a gate of the third thin-film transistor are respectively connected to the first signal output end, the direct-current low-voltage input end and the third signal input end in one-to-one correspondence; and a first pole, a second pole and a gate of the fourth thin-film transistor are respectively connected to the first node, the direct-current low-voltage input end and the third signal input end in one-to-one correspondence.

3. The GOA circuit according to claim 2, wherein the first pole is a drain, and the second pole is a source.

4. The GOA circuit according to claim 1, wherein the pull-up control unit comprises a fifth thin-film transistor, wherein:

a first pole, a second pole and a gate of the fifth thin-film transistor are respectively connected to the first signal input end, the first node and the second signal input end in one-to-one correspondence.

5. The GOA circuit according to claim 1, wherein the pull-down holding unit comprises a first pull-down holding circuit and a second pull-down holding circuit, wherein:

the first pull-down holding circuit is connected to the first node, the direct-current low-voltage input end, the first low-frequency clock signal input end and the first signal output end, and is configured to hold the output signal at the first signal output end at a low level; and the second pull-down holding circuit is connected to the first node, the direct-current low-voltage input end, the second low-frequency clock signal input end and the first signal output end, and is configured to hold the output signal at the first signal output end at a low level.

6. The GOA circuit according to claim 5, wherein the first pull-down holding circuit comprises a sixth thin-film transistor, a seventh thin-film transistor, an eighth thin-film transistor, a ninth thin-film transistor, a tenth thin-film transistor and an eleventh thin-film transistor, wherein:

a first pole, a second pole and a gate of the sixth thin-film transistor are respectively connected to the first node, the direct-current low-voltage input end and a first pole of the tenth thin-film transistor in one-to-one correspondence;

a first pole, a second pole and a gate of the seventh thin-film transistor are respectively connected to the first signal output end, the direct-current low-voltage input end and the first pole of the tenth thin-film transistor in one-to-one correspondence:

a first pole and a gate of the eighth thin-film transistor are both connected to the first low-frequency clock signal input end, and a second pole of the eighth thin-film transistor is connected to a first pole of the eleventh thin-film transistor;

a first pole, a second pole and a gate of the ninth thin-film transistor are respectively connected to the first low-frequency clock signal input end, the first pole of the tenth thin-film transistor and the first pole of the eleventh thin-film transistor in one-to-one correspondence;

a second pole and a gate of the tenth thin-film transistor are respectively connected to the direct-current low-voltage input end and the first node in one-to-one correspondence; and a second pole and a gate of the eleventh thin-film transistor are respectively connected to the direct-current low-voltage input end and the first node in one-to-one correspondence.

7. The GOA circuit according to claim 6, wherein the second pull-down holding circuit comprises a twelfth thin-film transistor, a thirteen thin-film transistor, a fourteenth thin-film transistor, a fifteenth thin-film transistor, a sixteenth thin-film transistor and a seventeenth thin-film transistor, wherein:

a first pole, a second pole and a gate of the twelfth thin-film transistor are respectively connected to the first node, the direct-current low-voltage input end and a first pole of the sixteenth thin-film transistor in one-to-one correspondence;

a first pole, a second pole and a gate of the thirteenth thin-film transistor are respectively connected to the first signal output end, the direct-current low-voltage input end and the first pole of the sixteenth thin-film transistor in one-to-one correspondence;

a first pole and a gate of the fourteenth thin-film transistor are both connected to the second low-frequency clock signal input end, and a second pole of the fourteenth thin-film transistor is connected to a first pole of the seventeenth thin-film transistor;

a first pole, a second pole and a gate of the fifteenth thin-film transistor are respectively connected to the second low-frequency clock signal input end, the first pole of the sixteenth thin-film transistor and the first pole of the seventeenth thin-film transistor in one-to-one correspondence;

a second pole and a gate of the sixteenth thin-film transistor are respectively connected to the direct-current low-voltage input end and the first node in one-to-one correspondence; and a second pole and a gate of the seventeenth thin-film transistor are respectively connected to the direct-current low-voltage input end and the first node in one-to-one correspondence.

8. The GOA circuit according to claim 1, wherein the transfer unit comprises an eighteenth thin-film transistor, wherein:

a first pole, a second pole and a gate of the eighteenth thin-film transistor are respectively connected to the first high-frequency clock signal input end, the second signal output end and the first node in one-to-one correspondence.

9. The GOA circuit according to claim 1, wherein the pull-up unit comprises a nineteenth thin-film transistor, wherein:

a first pole, a second pole and a gate of the nineteenth thin-film transistor are respectively connected to the first high-frequency clock signal input end, the first signal output end and the first node in one-to-one correspondence.

10. The GOA circuit according to claim 1, wherein the first pole is a drain, and the second pole is a source.

11. A liquid crystal display device, comprising a GOA circuit which comprises multistage GOA sub-circuits, wherein each stage of GOA sub-circuit comprises a pull-up control unit, a pull-up unit, a transfer unit, a pull-down unit, a pull-down holding unit and a bootstrap unit, wherein:

the pull-up control unit is connected to a first signal input end, a second signal input end and a first node, and is configured to output a voltage signal at the second signal input end to the first node under control of the first signal input end;

the pull-up unit is connected to a first high-frequency clock signal input end, a first signal output end and the first node, and is configured to output a clock signal at the first high-frequency clock signal input end to the first signal output end;

the transfer unit is connected to the first high-frequency clock signal input end, the first node and a second signal output end, and is configured to provide a voltage signal for a second signal input end of another stage of GOA sub-circuit;

the pull-down unit is connected to the first node, the first signal output end, a third signal input end and a direct-current low-voltage input end, and is configured to pull down an output signal at the first signal output end to a low level;

the pull-down holding unit is connected to the first node, the direct-current low-voltage input end, a first low-frequency clock signal input end, a second low-frequency clock signal input end and the first signal output end, and is configured to hold the output signal at the first signal output end at a low level; and the bootstrap unit comprises a first capacitor, a second capacitor, a first thin-film transistor and a second thin-film transistor, wherein a first end of the first capacitor is connected to the first node, and a second end of the first capacitor is connected to a first end of the second capacitor, a second end of the second capacitor being connected to the first signal output end; a first pole, a second pole and a gate of the first thin-film transistor are respectively connected to a second high-frequency clock signal input end, the first end of the second capacitor and a fourth signal input end in one-to-one correspondence; and a first pole, a second pole and a gate of the second thin-film transistor are respectively connected to the first end of the second capacitor, the direct-current low-voltage input end and the third signal input end in one-to-one correspondence.

12. The liquid crystal display device according to claim 11, wherein the pull-down unit comprises a third thin-film transistor and a fourth thin-film transistor, wherein:

a first pole, a second pole and a gate of the third thin-film transistor are respectively connected to the first signal output end, the direct-current low-voltage input end and the third signal input end in one-to-one correspondence; and a first pole, a second pole and a gate of the fourth thin-film transistor are respectively connected to the first node, the direct-current low-voltage input end and the third signal input end in one-to-one correspondence.

13. The liquid crystal display device according to claim 12, wherein the first pole is a drain, and the second pole is a source.

14. The liquid crystal display device according to claim 11, wherein the pull-up control unit comprises a fifth thin-film transistor, wherein:

a first pole, a second pole and a gate of the fifth thin-film transistor are respectively connected to the first signal input end, the first node and the second signal input end in one-to-one correspondence.

15. The liquid crystal display device according to claim 11, wherein the pull-down holding unit comprises a first pull-down holding circuit and a second pull-down holding circuit, wherein:

the first pull-down holding circuit is connected to the first node, the direct-current low-voltage input end, the first low-frequency clock signal input end and the first signal output end, and is configured to hold the output signal at the first signal output end at a low level; and the second pull-down holding circuit is connected to the first node, the direct-current low-voltage input end, the second low-frequency clock signal input end and the first signal output end, and is configured to hold the output signal at the first signal output end at a low level.

16. The liquid crystal display device according to claim 15, wherein the first pull-down holding circuit comprises a sixth thin-film transistor, a seventh thin-film transistor, an eighth thin-film transistor, a ninth thin-film transistor, a tenth thin-film transistor and an eleventh thin-film transistor, wherein:

a first pole, a second pole and a gate of the sixth thin-film transistor are respectively connected to the first node, the direct-current low-voltage input end and a first pole of the tenth thin-film transistor in one-to-one correspondence;

a first pole, a second pole and a gate of the seventh thin-film transistor are respectively connected to the first signal output end, the direct-current low-voltage input end and the first pole of the tenth thin-film transistor in one-to-one correspondence;

a first pole and a gate of the eighth thin-film transistor are both connected to the first low-frequency clock signal input end, and a second pole of the eighth thin-film transistor is connected to a first pole of the eleventh thin-film transistor;

a first pole, a second pole and a gate of the ninth thin-film transistor are respectively connected to the first low-frequency clock signal input end, the first pole of the tenth thin-film transistor and the first pole of the eleventh thin-film transistor in one-to-one correspondence;

a second pole and a gate of the tenth thin-film transistor are respectively connected to the direct-current low-voltage input end and the first node in one-to-one correspondence; and a second pole and a gate of the eleventh thin-film transistor are respectively connected to the direct-current low-voltage input end and the first node in one-to-one correspondence.

17. The liquid crystal display device according to claim 16, wherein the second pull-down holding circuit comprises a twelfth thin-film transistor, a thirteen thin-film transistor, a fourteenth thin-film transistor, a fifteenth thin-film transistor, a sixteenth thin-film transistor and a seventeenth thin-film transistor, wherein:

a first pole, a second pole and a gate of the twelfth thin-film transistor are respectively connected to the first node, the direct-current low-voltage input end and a first pole of the sixteenth thin-film transistor in one-to-one correspondence;

a first pole, a second pole and a gate of the thirteenth thin-film transistor are respectively connected to the first signal output end, the direct-current low-voltage input end and the first pole of the sixteenth thin-film transistor in one-to-one correspondence;

a first pole and a gate of the fourteenth thin-film transistor are both connected to the second low-frequency clock signal input end, and a second pole of the fourteenth thin-film transistor is connected to a first pole of the seventeenth thin-film transistor;

a first pole, a second pole and a gate of the fifteenth thin-film transistor are respectively connected to the second low-frequency clock signal input end, the first pole of the sixteenth thin-film transistor and the first pole of the seventeenth thin-film transistor in one-to-one correspondence;

a second pole and a gate of the sixteenth thin-film transistor are respectively connected to the direct-current low-voltage input end and the first node in one-to-one correspondence; and a second pole and a gate of the seventeenth thin-film transistor are respectively connected to the direct-current low-voltage input end and the first node in one-to-one correspondence.

18. The liquid crystal display device according to claim 11, wherein the transfer unit comprises an eighteenth thin-film transistor, wherein:

a first pole, a second pole and a gate of the eighteenth thin-film transistor are respectively connected to the first high-frequency clock signal input end, the second signal output end and the first node in one-to-one correspondence.

19. The liquid crystal display device according to claim 11, wherein the pull-up unit comprises a nineteenth thin-film transistor, wherein:

a first pole, a second pole and a gate of the nineteenth thin-film transistor are respectively connected to the first high-frequency clock signal input end, the first signal output end and the first node in one-to-one correspondence.

20. The liquid crystal display device according to claim 11, wherein the first pole is a drain, and the second pole is a source.

* * * * *